United States Patent [19]

Neidecker et al.

[11] Patent Number: 4,725,251

[45] Date of Patent: Feb. 16, 1988

[54] ELECTRIC CONTACT DEVICE

[75] Inventors: Rudolf Neidecker, Basel; Jacques Kunz, Schönenbuch; Felix Riedl, Mühldorf, all of Switzerland

[73] Assignee: Multi-Contact AG Basel, Sommergasse, Switzerland

[21] Appl. No.: 11,503

[22] Filed: Feb. 5, 1987

[30] Foreign Application Priority Data

Jul. 31, 1986 [DE] Fed. Rep. of Germany ..... 3625864

[51] Int. Cl.[4] ..... H01R 13/11

[52] U.S. Cl. ..... 439/843

[58] Field of Search ..... 439/843, 851, 852, 860

[56] References Cited

U.S. PATENT DOCUMENTS

| | | | |
|---|---|---|---|
| 3,956,607 | 5/1976 | VanWijnandsbergen | 439/843 |
| 4,120,557 | 10/1978 | Horrocks | 439/843 |
| 4,128,293 | 12/1978 | Paoli | 439/843 |

*Primary Examiner*—Joseph H. McGlynn

*Attorney, Agent, or Firm*—Tarolli, Sundheim & Covell

[57] ABSTRACT

An electric contact device for an electrical connection of electroconductive connectors comprises a row of interconnected contact elements which are joined together by at least one continuous band-shaped or wire-shaped spring element. Each contact element is provided with at least one opening through which the spring element extends. The opening provides for fixing of the contact element which, in an unstressed condition, extends at an angle maximum 45° relative to the plane of the spring element. Under the contact pressure, the spring element is deformed and takes a wave form, thus, producing a resilient force. This permits to assemble the device with larger tolerances for spacing between the contact elements. Preferably, the edges of the contact elements have a high electric conductivity.

33 Claims, 36 Drawing Figures

ELECTRIC CONTACT DEVICE

The invention relates to an electric contact device for forming a connection between wire connectors which device comprises a plurality of contact elements and at least one spring element for biasing the contact elements against the wire connectors.

Different variations of contact devices of this kind are known or have been proposed. They produce an easily detachable electric connection or a bridge between electroconductive connectors. The contact devices are used, in particular, in electric plug connections as resilient intermediate members. In a plug-socket connection, the contact device may be fastened either to the socket or to the plug. Another use is for bridging of bars. At the overlapping connection areas of the bars, the contact devices are arranged between pressed together bar sections. The contact devices may also be used in switching devices as sliding contacts, in which case they are fastened either to the stationary or the movable contact base of the switching device.

These contact devices should, on one hand, assure a secure mechanical contact between the connectors after long periods of use and, possibly, after a large number of switching operations, and, on the other hand, should have the least possible resistance to transmission of electricity between the joined connectors. Both conditions are influenced in detachable contacts by suitable choice of material of the conductors and by suitable dimensioning of the contact pressure.

For materials available at present, good electric conductivity and good spring-mechanical properties are mutually exclusive. Using different materials results in optimal conductive and spring properties. German Published Application No. 3,014,118 discloses a contact element comprising a flat conductor with a spring element connected therewith. Because of functional separation of the electrical conductor from the spring element, both parts can be made of the most suitable materials.

As already mentioned, such contact devices should assure, along with the least possible resistance to electric transmission between the connectors, a reliable mechanical contact between the connectors. According to the German Published Application No. 3,014,118 mentioned above, the first part of the problem, namely, the reduction of transmission resistance, was dealt with. On the other hand, the second part of the problem, namely, a reliable mechanical contact, or the contact pressure to be applied through springs, was not sufficiently considered. Namely, despite good spring properties, the attainable spring distance, which determines the range of movement of the contact remains relatively small according to this proposal. This results in the danger that the springs will easily be overstretched and, thus, weakened. Moreover, the zone of operation of the contact device is limited because of the small spring range, and the contact elements must be manufactured with close tolerances, so that a perfect contact will remain even after a long period. But an especially serious disadvantage of this proposal consists in the considerable technical and production outlay, and, thus, also in the high costs of production, especially because of a complicated connection between the contact element and the spring element.

The object of the present invention is to substantially improve the electric contact device of the kind mentioned, so that, by suitable design of the spring element or the connection between the spring element and the contact element, a greatly improved contact pressure between the contact elements and connectors can be assured, which can also be retained even under changing conditions or with greater dimensional tolerances for the contact elements involved. Also, in particular, the production cost of the contact device should also be decreased.

This problem is solved, according to the invention by providing the spring element in the form of a band or wire and by providing the band or the contact elements with openings engaged, respectively, by the contact elements or the spring wire.

The distinct advantages of these measures consists in the ideal utilization of the good spring properties of the spring material used and a much greater tolerance range made possible because of it for the contact elements and, despite the increased dimensional tolerances, the surprisingly high safety and reliability, as well as uniformity, of the desired contact pressure. The cost of production for the design described is relatively low, as compared with the known designs. The proposed design requires few, simple and easy-to-control production steps.

Details of the invention will be described below with reference to preferred embodiments and the accompanying drawings. In the drawings.

Figure 1C:
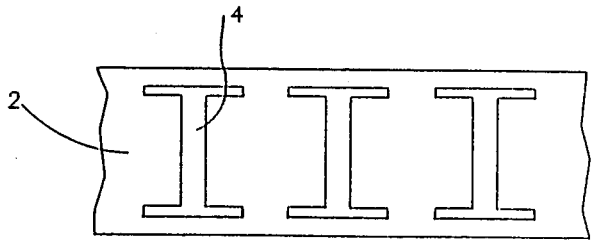
FIG. 1C shows a top of the spring band.
Figure 1D:
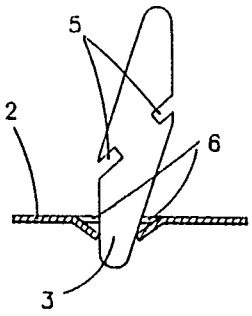
FIG. 1D shows the contact element insertable into the spring band.
Figure 1A:
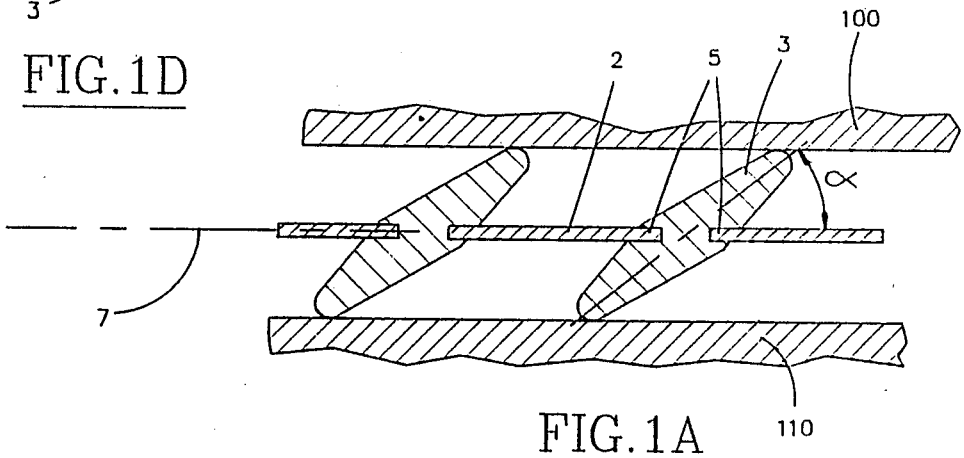
FIG. 1A shows a fragmental sectional view of the first embodiment of the contact device.

The electric contact device 1 shown in FIGS. 1A to 1D consists of a spring band 2, into which are inserted contact elements 3 arranged in a Venetian blind fashion. As appears, especially from FIGS. 1A and 1D, the contact elements 3 are provided, from both sides, with inclined catch grooves 5. These grooves have a thickness corresponding to the thickness of the spring band 2, so that the contact elements 3 can be pressed and held thereon (see FIG. 1D).

The catch grooves 5 are inclined at an angle in relation to the plane of the contact element 3 to obtain the desired angle of inclination in relation to the plane 7 of the spring band 2. The angle at which the contact elements 3 are inclined relative to the plane 7 of the spring band, may practically be equal between a few degrees and approximately 45°.

The spring band 2 may be formed of spring steel or spring bronze, for example, of Cu/Be bronze. As contact material, preferably one which is a good electrical conductor, is used. It should be noted that the height of the contact elements 3 is independent of the mutual distance of the same along the spring band 2. This means that it is possible, by proper choice of the contact height, to bridge over even rather great tolerances between two connectors to be joined electrically with each other, without decreasing the number of contact elements based on the length of the spring band. The desired high current carrying capacity remains fully assured, therefore.

Figure 1B:
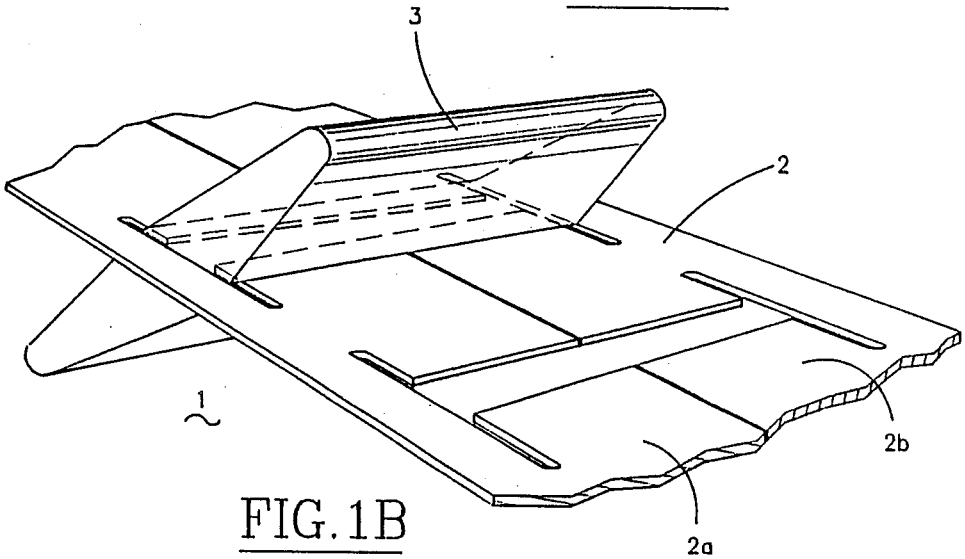
FIG. 1B shows a perspective view of a part of a spring band with a single contact therein.

The spring band 2 may be assembled from two bands 2*a*, 2*b* which are joined together. This has the advantage that during the mounting of the contact elements 3, edges 6 of a slot 4 need not be bent away (as shown in FIG. 1B). Rather, in this case, the bands 2*a*, 2*b* can be pushed sidewise into the catch grooves 5, and then joined with each other, if desired.

Figure 2A:
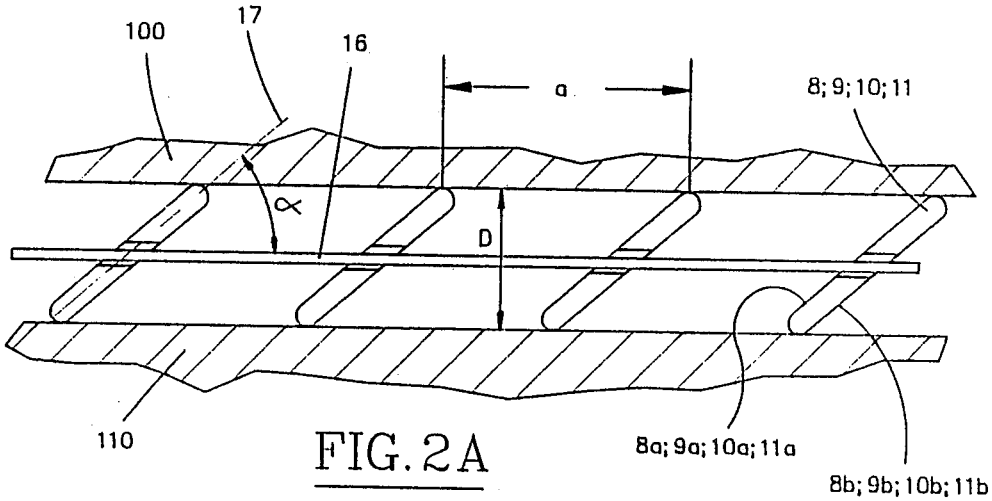
FIG. 2A shows a fragmental cross-sectional view of the second embodiment of two contacts and a contact device in an unstressed condition.

The operation of the contact device is explained with reference to FIGS. 2A and 2B. It is definitely different from the operation of devices of this kind known up to now. In the unstressed condition, according to FIG. 2A, the spring band 16 is flat. The contact elements 8 to 11 are lined up on the spring band 16 at a distance A under angle $\alpha$ relative to the lane of the spring band. The angle $\alpha$ is preferably 40°. Now, if, under the influence of a contact pressure, exerted between a first connector 100 and a second connector 110 on the electric contact device, the gap D is narrowed to the amount D1 (FIG. 2B), the contact elements 8 to 11 necessarily take a more inclined position. This means that the angle $\alpha$ is reduced. As a result of a contact between the contact elements 8 to 11 and the spring band 16, the latter takes a wavy form, as shown, for example, in FIG. 2B.

Through this measure, an additional resilience of the spring system is attained which provides for longer useful spring distances and, thus, for resilient forces being evenly distributed and insensitive to dimensional tolerances. Also, the device described allows greater setting angles of the contact elements and substantially constant spring pressure of the contact elements against the connectors 100 and 110.

Figure 3A:
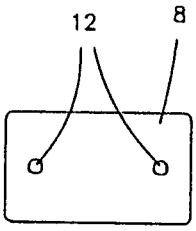
FIG. 3A shows a contact element for mounting on two spring wires.
Figure 2B:
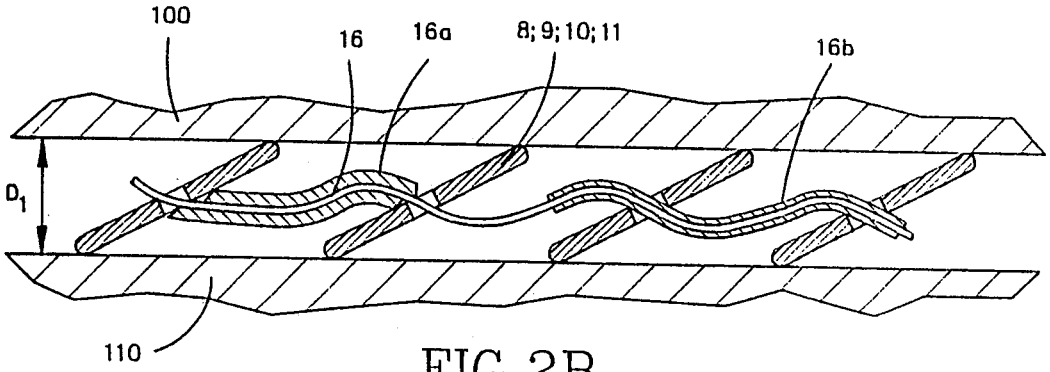
FIG. 2B shows a fragmental cross-sectional view of two contact elements and the contact device in stressed condition, that is, after applying the contact pressure.

FIG. 2B also shows, in the zone of the two outer left contact elements an especially advantageous spacer 16*a* which is simple and reliable. The spacer has a form of a hose section overlying the spring band 16. It is made, preferably, of soft elastic or soft plastic material and, therefore, its end surface can adapt to various angular positions of adjacent contact elements. This also, if desired, may provide for an increase of the contact pressure which can be influenced by suitable dimensioning and choice of material. Such spacers may also be considered, with special advantage, for designs with spring wires (see FIG. 3A).

Conveniently, resilient spacers at least partially elastically deformable in the axial direction with a certain axial compression between the contact elements, are used. This is insured in mounting by alternate placing of contact elements and spacers on the spring band or spring wire, conveniently attained by compressing the assembly with adjacent end stops, or connecting the ends of the band or wire. The axial prestress of the spacers provides for securing the position of the contact elements free of play, but resilient and adaptable to the operational condition. This is favored also by using plate-like contact elements with simple prismatic or cylindrical openings extending through the plane of the plate for receiving of the spring band or spring wire. This has considerable production advantages without impairing the securing in position of the contact element without or with little play.

A modification of this form of execution is shown in the righthand portion of FIG. 2B. According to this, resilient positioning of a contact element is obtained by means of an elastic and/or plastic radially compressable hose 16b surrounding the spring band or spring wire, and extending continuously over a plurality of contact elements. With suitable dimensioning of the openings of the contact elements, on the one hand, the spring element with a hose can still be conveniently introduced into the openings during assembly. On the other hand, the radial compression of the hose section, inside the contact element openings provides for a secure force closing or even geometrical closing position of the contact element because of driving the hose material into the adjacent zones outside the openings, which at the same time is resilient. If desired, additional hose sections may be placed between the contact elements.

Generally, it is obvious that the applicable hose profile need not necessarily be closed on the circumference. Rather, in principle, any suitable open profile may be considered, for example, a U-profile. It is also obvious that spacer (not specially represented in FIG. 2B) may be used, in common, over a large number or over a whole series of contact element.

FIGS. 3A to 3D show examples of embodiments of suitable forms of contact elements. The contact element 8, according to FIG. 3A has two holes 12, inclined relative to contact plane 17 (see FIG. 2A), for the passage of spring wires.

Figure 3B:
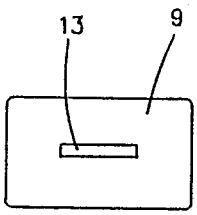
FIG. 3B shows the contact element for mounting on a central spring band.

FIG. 3B shows a central slot 13 (see FIG. 2A) inclined relative to the contact plane 17 to receive a spring band.

Figure 3C:
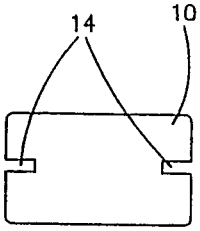
FIG. 3C shows another embodiment of a contact element for mounting on two spring wires.
Figure 3D:
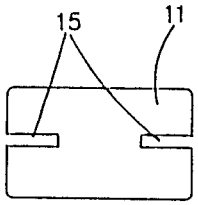
FIG. 3D shows a contact element mounted on two spring bands.

FIGS. 3C and 3D show contact elements 10, 11 which have openings 14, 15 for the insertion of spring wires (FIG. 3C) or spring bands (FIG. 3D). These openings 14, 15 can easily be closed, after introducing the spring elements, by compression or squeezing.

Figure 4:
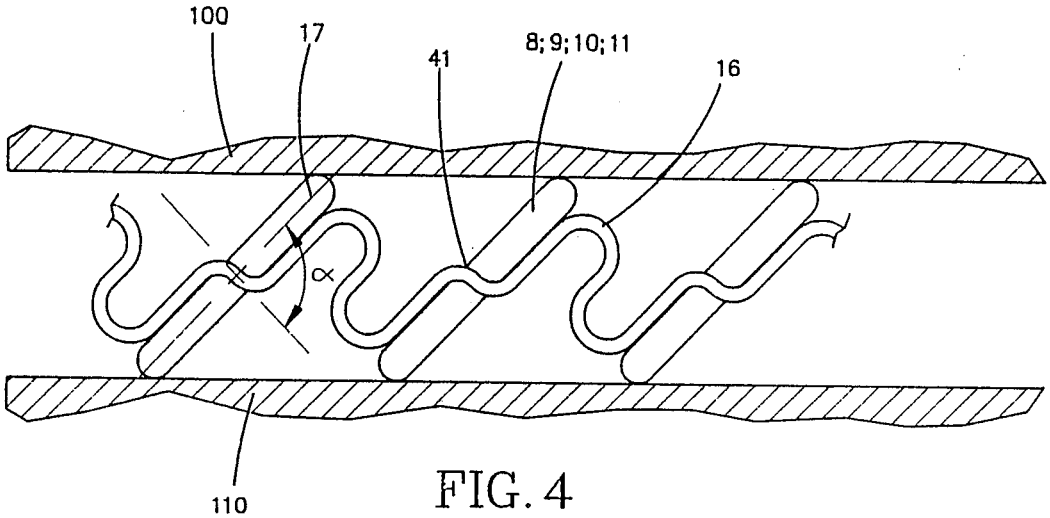
FIG. 4 shows a series of contact elements arranged on corrugated spring band or corrugated spring wires.

FIG. 4 shows an example with a multibent spring band or spring wire 16. Such spring bands or wires contribute to a further lengthening of the spring zone. Another advantage is that the passage 41 for the spring wire or spring band 16 can be made perpendicular (that is, X=90°), to the plane 17 of the contact elements 8 to 11. Despite this, a desired geometrical closing connection is produced between the spring element and the contact elements so that the rotary movement of the contact element described above, is perfectly transformed into a suitable elastic deformation of the spring element.

Figure 5C:
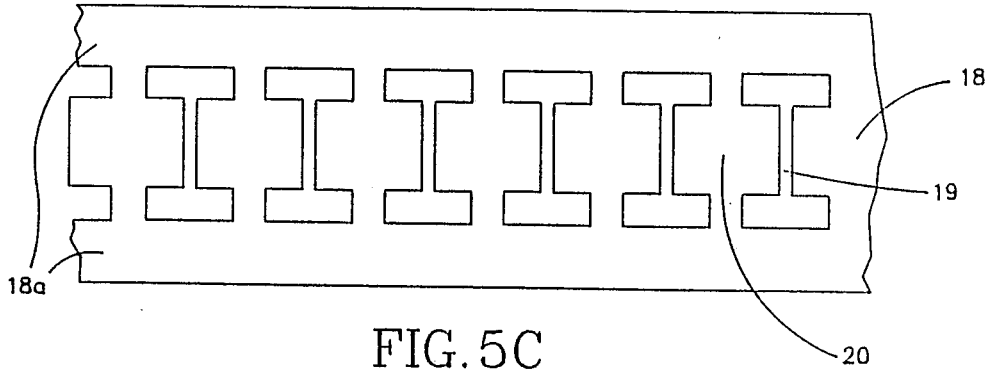
FIG. 5C shows a fragmental top view of the spring band.
Figure 5A:
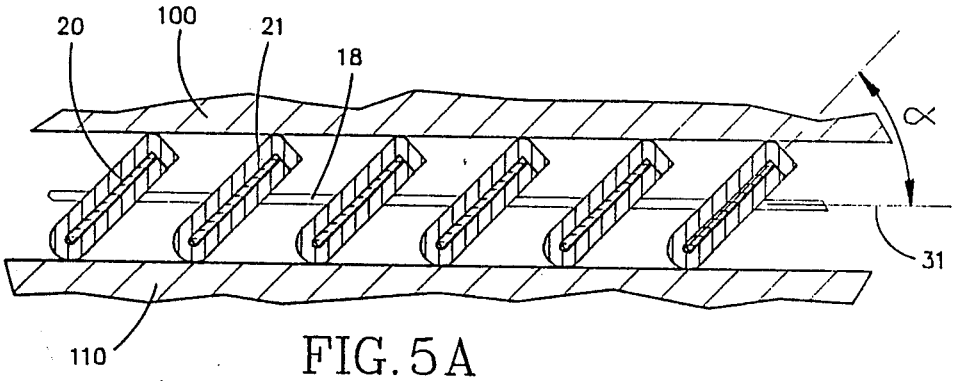
FIG. 5A shows a fragmental sectional view of a third embodiment of a contact device.
Figure 5B:
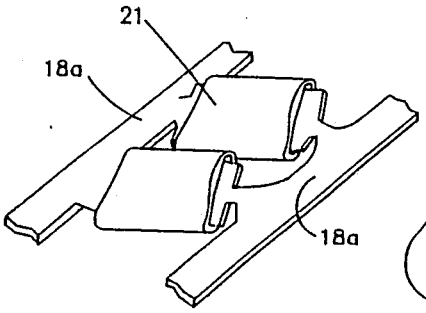
FIG. 5B shows a perspective view of a part of a spring band with two contact elements mounted thereon.
Figure 5D:
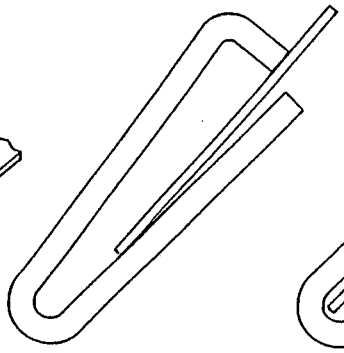
FIG. 5D shows the contact element during mounting on the spring band.
Figure 5E:
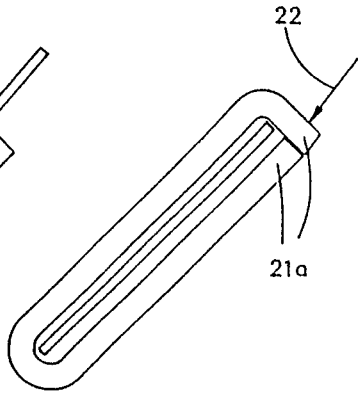
FIG. 5E shows the contact element in a mounted condition.
Figure 5F:
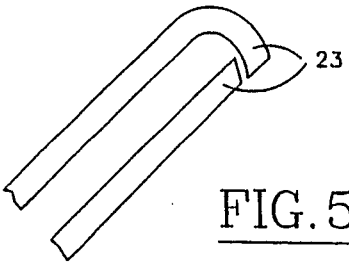
FIG. 5F shows another embodiment of the contact element in a mounted condition.

FIGS. 5A and 5F show an electric contact device in which the contact elements are defined by pockets 21 formed of a material with high electric conductivity, such as copper, for example, which are arranged in each case on a stay 20 of the spring band 18 (see FIGS. 5A, 5E), and completely enclose the latter. Openings 19 are stamped out in the spring band 18 resulting in forming stays 20 (see FIG. 5C). These are rotated by an angle in relation to the plane 31 of the spring band (see FIG. 5A). As a result, the stays 20 can spring, with torsion, in relation to the edges 18a of the spring band 18. The assembly of the pocket-form contact elements is very simple. They ar pushed over the assigned stays 20 and are connected adjacent their end zones 21a by geometrical closing or material closing, for example, with an aid of spot welding 22 (see FIGS. 5D, 5E). According to the embodiment shown in FIG. 5F, the fastening problem can also be solved by making the end zones 21a in claw form which engage each other. In this case, the use of a material closing connection can sometimes be omitted. FIG. 5B shows a perspective sectional view of the electric contact device with two pockets 21.

Figure 6C:
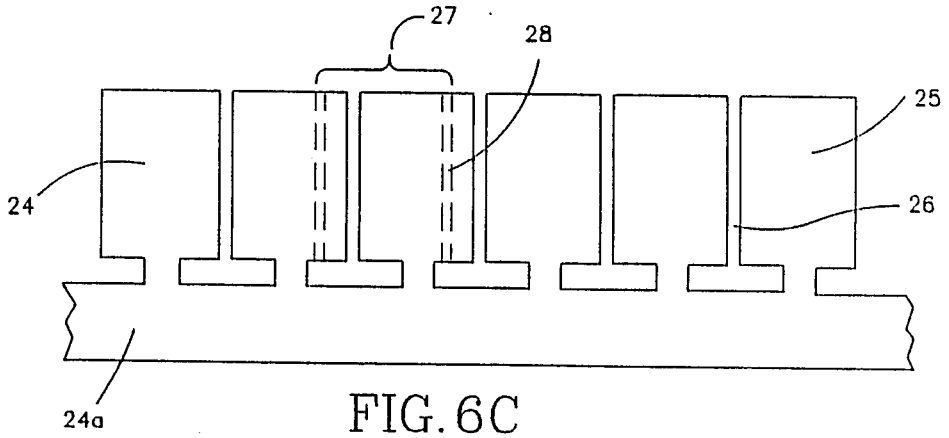
FIG. 6C shows a top sectional view of the spring band.
Figure 6A:
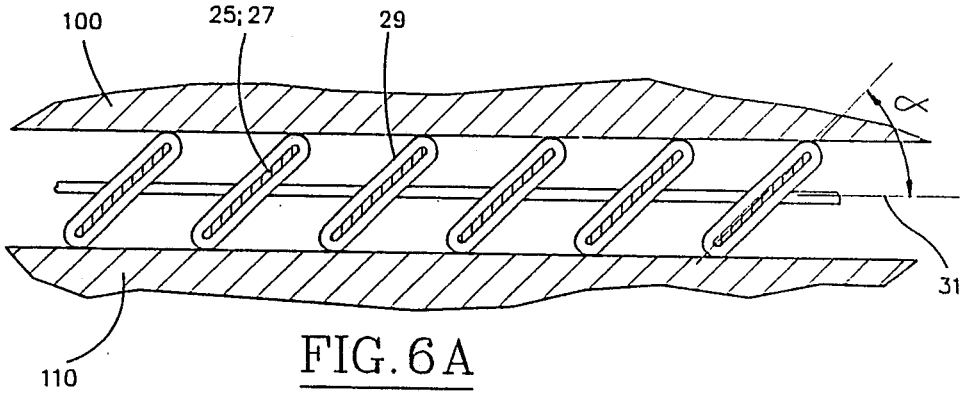
FIG. 6A shows a fragmental sectional view of a fourth embodiment of the contact device.
Figure 6D:
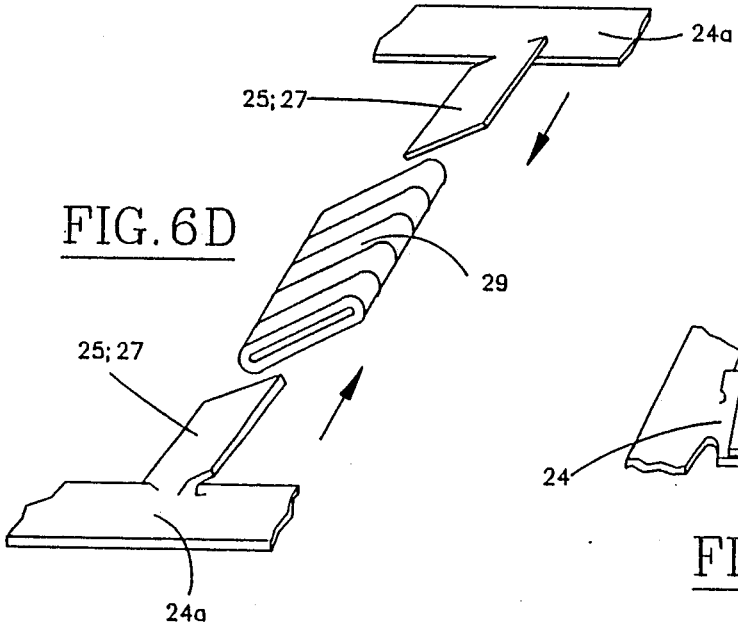
FIG. 6D shows mounting of the contact element on two spring bands.
Figure 6B:
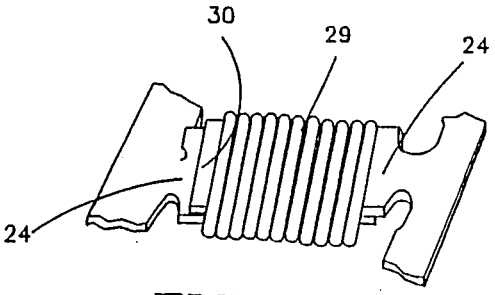
FIG. 6B shows a perspective fragmental view of two spring bands joined together with a contact element mounted thereon.
Figure 6E:
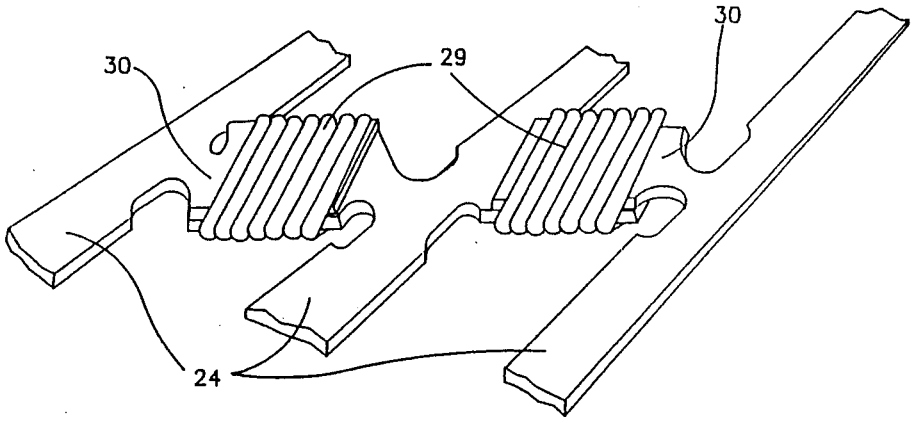
FIG. 6E shows a perspective fragmental view of three spring bands, joined together, with two contact elements mounted thereon.

FIGS. 6A to 6E show an electric contact device which contact elements are formed by coils 129 of a material with high electric conductivity (which, again, may be copper), which in each case are arranged on tongues 25, 27, connected together or possibly only held in mutual contact and which belong to different spring bands 24 and are pushed into the coil 29 from opposite ends (see FIG. 6B). Consequently, in each case, the two tongues 25, 27 are completely enclosed by the coil 29 (see FIG. 6B). The electric contact device consists also of t least two spring bands 24, lying side-by-side. Openings 26, 28 are stamped out from each spring band 24 resulting in forming tongues 25, 27 which are joined by a connection strip 24a in one piece (see FIG. 6C). The tongues 25, 27 are twisted relative to the spring band plane by an angle (see FIG. 6A). As a result, in turn, the tongues 25, 27 can spring in torsion relative to the connection strip 24a which connects them. With this, the axis of torsion and the axis of symmetry may coincide or the former may be eccentric in relation to the latter (see tongue 27, in broken line, in FIG. 6C). The mounting of the coil-form contact is effected by pushing it in the assigned tongues 25, 27 (see FIG. 6D). The individual pairs of tongues 25, 27 are then connected with each other, for example, by spot welding 30. The assembly carried out in this way is distinguished by its simplicity. The coil-form contact element may be arranged in several rows (see FIG. 6E).

Obviously, the contact elements used in the embodiment of FIGS. 5A to 5F, may also be in the coil form, and those used in the embodiment of FIGS. 6A to 6E may also be in the pocket form. Moreover, the stays 20 or the pairs of tongues 25, 27, joined together, may also be arranged in more than two rows.

To assure a perfect closing, with improved pressing conditions, examples of the contact elements are described below, in further development of the principles of the invention, which are especially suitable for use with the designs described above.

It is known that particularly the lengthwise edges of the contacts 3 and 8 to 11 serve as contact bridges for the connectors 200, 210. These parts of the contact elements are especially strongly loaded, dependent on the particular current charge between the connection elements.

Figure 7:
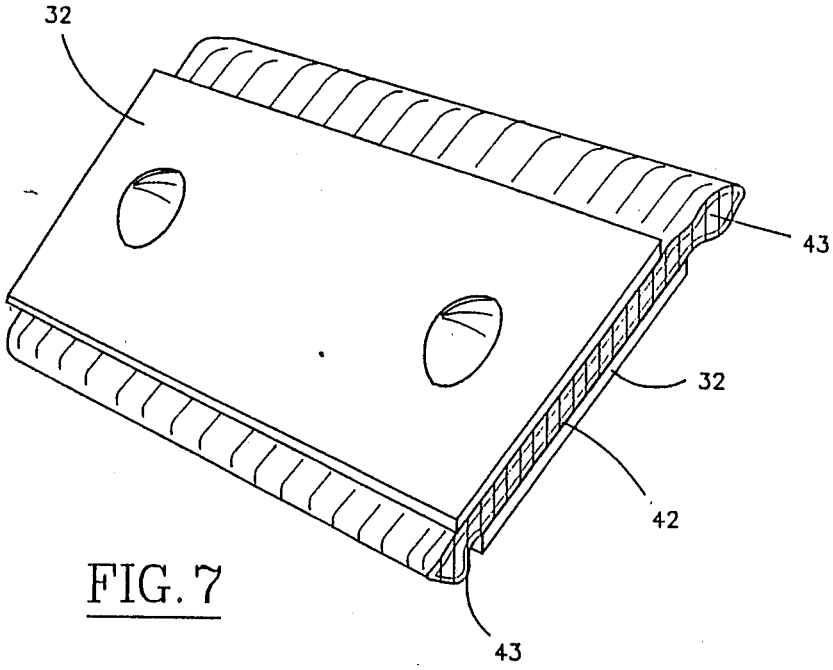
FIG. 7 shows a contact element comprising a contact lamella of a material with high electric conductivity clamped as sandwich between two outer contact plates.

According to FIG. 7, the contact element consists of first and second outer contact parts 32, as well as a contact lamella 42, clamped between them and of which the ends 43 project beyond the contact parts 32. The outer contact parts 32 can be made of metal, plastic or other material having the necessary mechanical properties. The contact lamella 42, lying between them must, above all, have good electrical properties; the mechanical properties of this lamella 42, such as sufficient strength, play a subordinate part. As material for the lamella 42 may be used, for example, a copper braiding.

Figure 8:
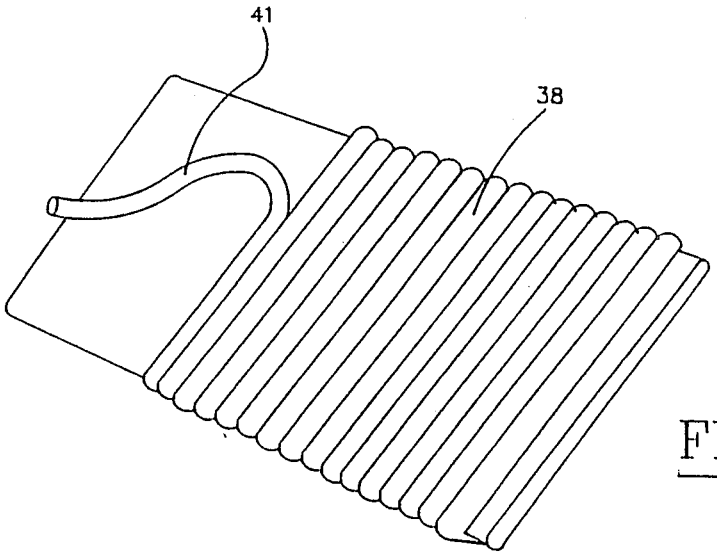
FIG. 8 shows a contact element wound with contact material.

According to FIG. 8, the contact element is made of metal or insulating material and wound with a wire 41 of highly electroconductive material or with a flexible conductor.

Figure 9:
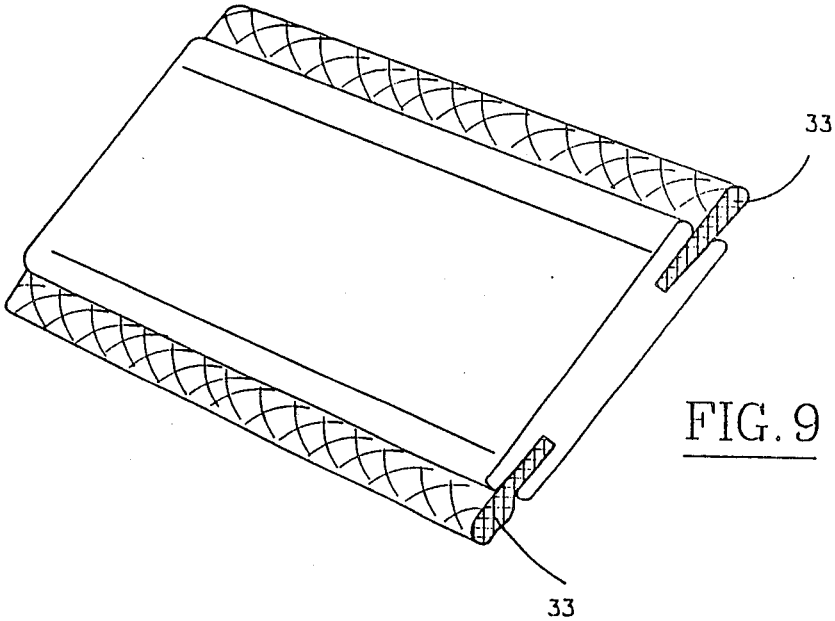
FIG. 9 shows a contact element with an insertable contact lamella.

According to the embodiment shown in FIG. 9, only the edge zones are provided with an inserted contact lamella 33 of a highly electroconductive material. For this purpose, the edge zones are provided with grooves.

Figure 10A:
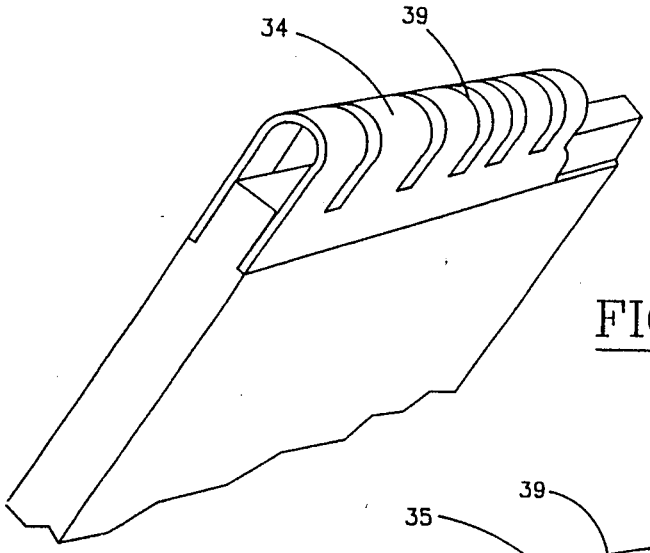
FIGS. 10A to 10C show examples of embodiments of contact elements with a spring contact lamella at the edge sections.
Figure 10B:
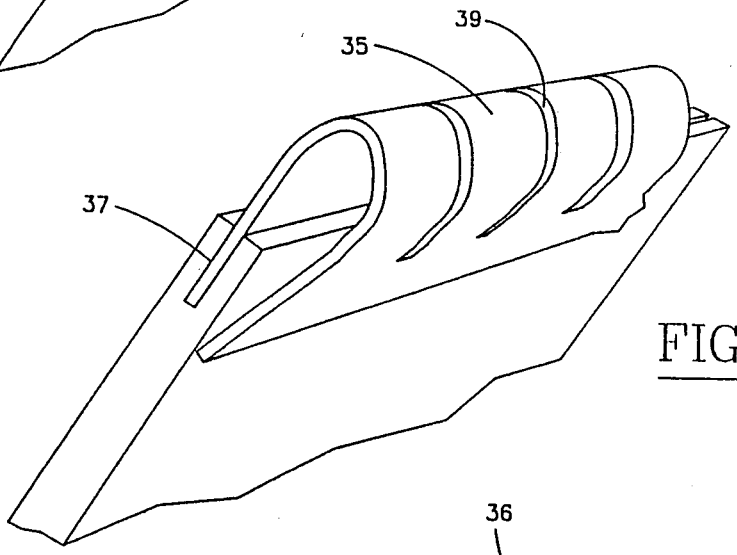
Figure 10C:
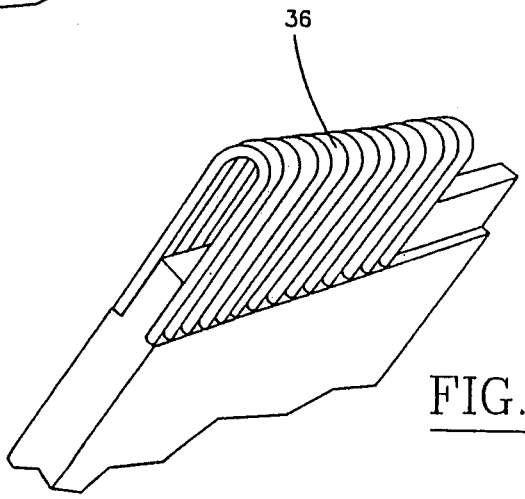

FIGS. 10A to 10C show other embodiments of contact element also having electroconductivity through spring contact lamella. The contact lamella 34, according to FIG. 10A has a U-shaped cross-section and is bent over one end of the contact element. According to FIG. 10B, the contact lamella 35 is inserted with one end into a groove 37 in the contact element. Finally, the contact lamella 36, according to FIG. 10C, may be of phosphorus bronze wire, and, like the contact lamella 34 according to FIG. 10A, may be bent over one end of the contact element. The contact lamellas 34, 35, shown in FIGS. 10A and 10B, have also slots 39 defining several resilient contact zones arranged side-by-side and independent of each other.

Figure 12:
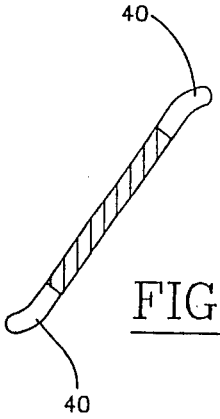
FIG. 12 shows a cross-section of the contact element shown in FIG. 11.
Figure 11:
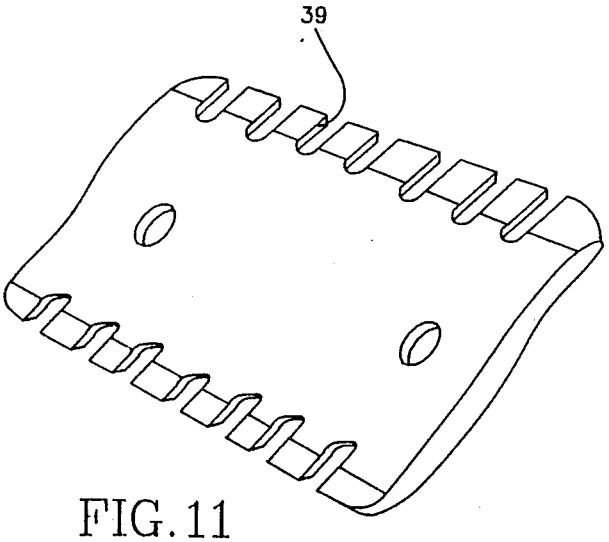
FIG. 11 shows a contact element with a slotted contact lamella.

The embodiment of FIG. 11 shows a contact element which consists of a conductor plate provided at the contact surface with slots 39. According to FIG. 12, the contact edges 40 might also be beveled slightly.

The embodiments of the contact described in connected with FIGS. 7 to 11, are especially suitable for high current carrying load of the contact device when used with connectors which, because of their mutual position and/or manufacturing tolerances of their surfaces, do not offer assurance that a substantially rigid contact will be maintained against the surface of the connectors along the whole contact edge.

Figure 13:
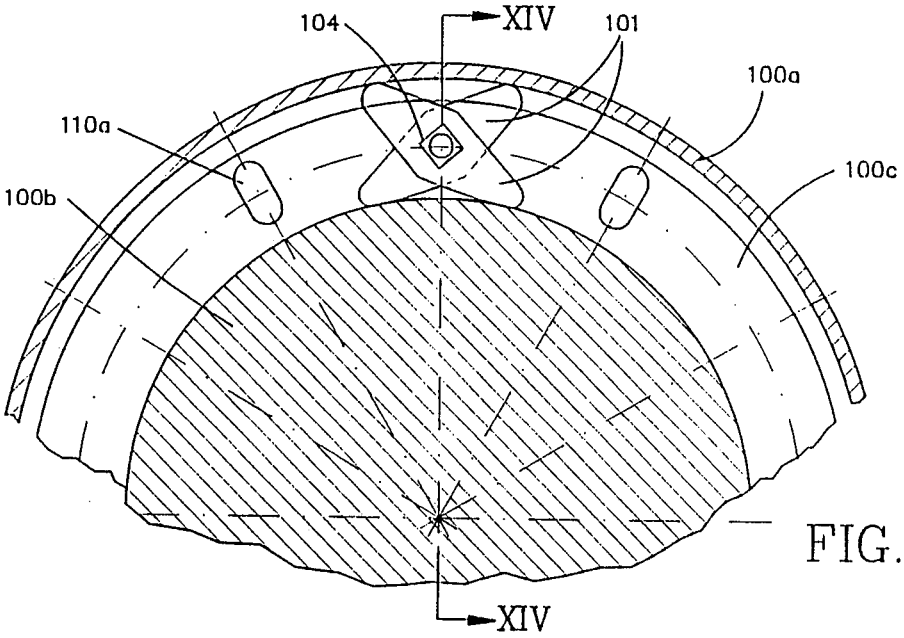
FIG. 13 shows a fragmental cross sectional view along section plane XII—XII in FIG. 14 of a contact device with coaxial cylindrical connectors and contact elements inserted between the connectors.
Figure 14:
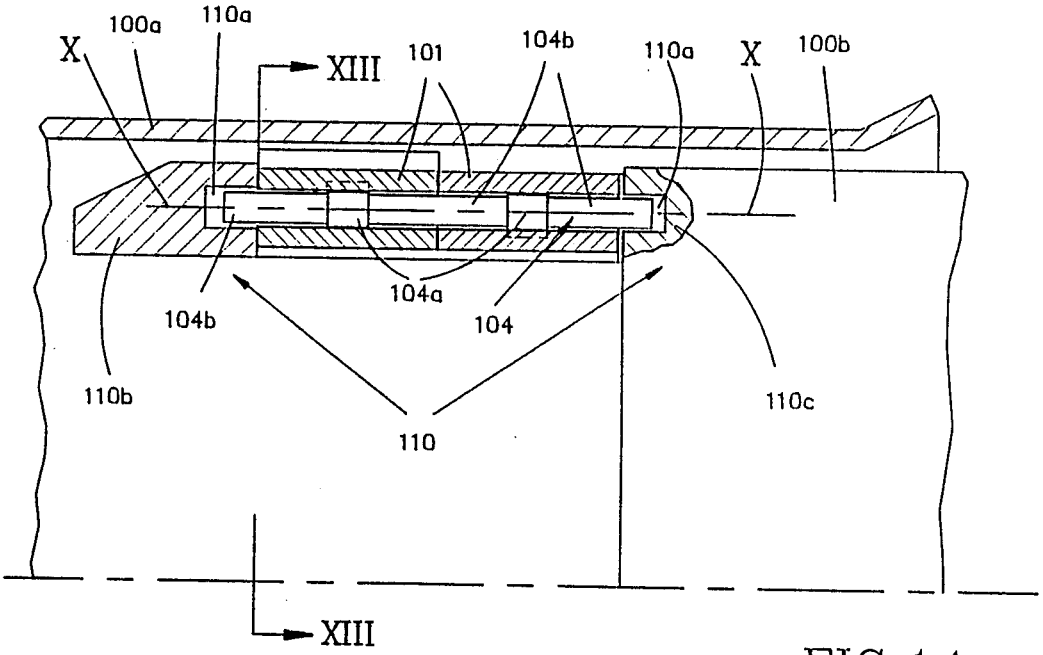
FIG. 14 shows a fragmental axial section of the contact device according to FIG. 13 taken along section plane XIV—XIV in FIG. 13.
Figure 15:
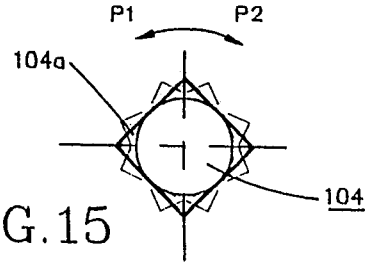
FIG. 15 shows a side view on a larger scale of a spring element of the contact device of FIG. 13.

In the contact device according to FIGS. 13 to 15, in each case, two plate-like prismatic rigid contact elements 101 are arranged parallel to the axis of cylindrical connectors **100*a* and 100*b*, one after the other, and are connected with each other by a rod-shaped torsion spring 104. The latter includes two axially spaced rectangular-profiled sections 104*a* and is located in aligned rectangular channels 101*a* of the two contact elements 101 adapted to the profile sections 104*a* and, thus, providing a geometrically closing torsion connection between the contact elements arranged one after the other. Of the other cylindrical rod sections 104*b* of the torsion spring, the middle one arranged between the two rectangular profile sections 104*a*, acts as elastic spring element, which can be twisted, while the two outer ones project beyond the end surfaces of the contact element and engage in radial slots 110*a* of ring elements 110*b* and 110*c* on both sides of a cage-like guide device 110. In this way, the pivot axes X—X of the coaxial contact elements upon mutual pivotal movement thereof can move radially relative to the axis of the cylindrical connectors 100*a*, 100*b***, without the danger of tilting which may result from its tangential inclination relative to the connectors.

In the unstressed condition of the torsion springs, the two contact elements, at right angles to each other, upon insertion between the contact surfaces of the connectors **100*a* and 100*b* under elastic deformation of the torsion springs according to arrows P1 and P2 in FIG. 15 with a prestress, take their position according to FIG. 13. Thereby, the outer lengthwise edges of the contact elements lie, under a pressure corresponding to the original prestress, against the contact surfaces of the connectors. The ring elements 110*a* and 110*b* of the guide device 110 also provide an exact axial stopping of the guide body, so that a repeated axial displacement of the connectors in relation to each other is possible. The connectors can therefore be designed, in particular, as a socket and a plug, as indicated in FIGS. 13 and 14. For the rest, in FIG. 13, for the sake of clarity, only one pair of contact elements is shown in the space between the two connectors. As it can be seen, the complete setting of the available contact surfaces with contact arrangements, according to the number of pairs of aligned slots 110*a***, lying opposite each other, makes possible contact devices having a simple construction for high current carrying loads.

Figure 16:
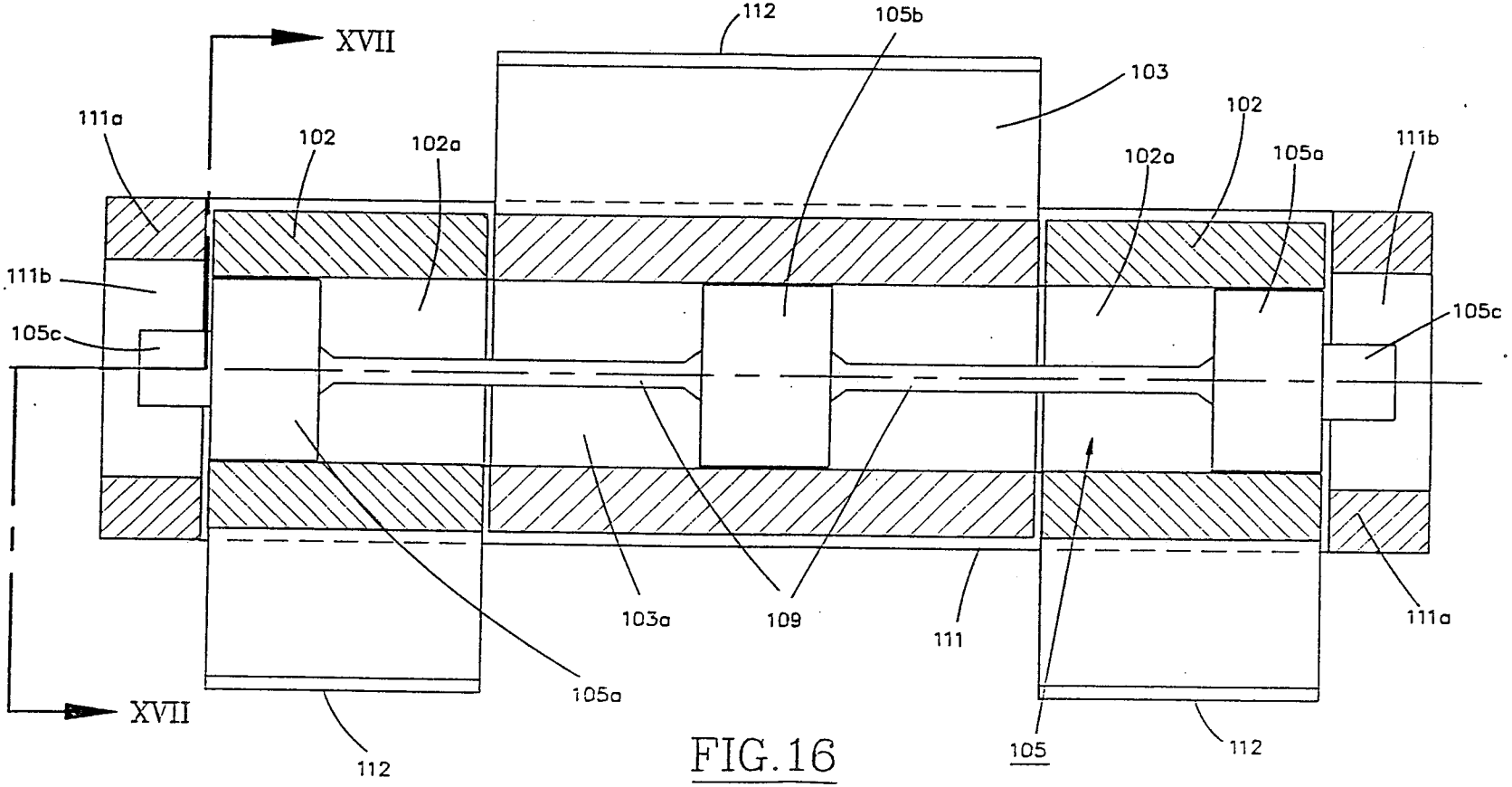
FIG. 16 shows a longitudinal sectional view along lines XVI—XVI of FIG. 17 of a set of integral contact elements with a spring element and a guide device of another contact device in an enlarged scale.
Figure 17:
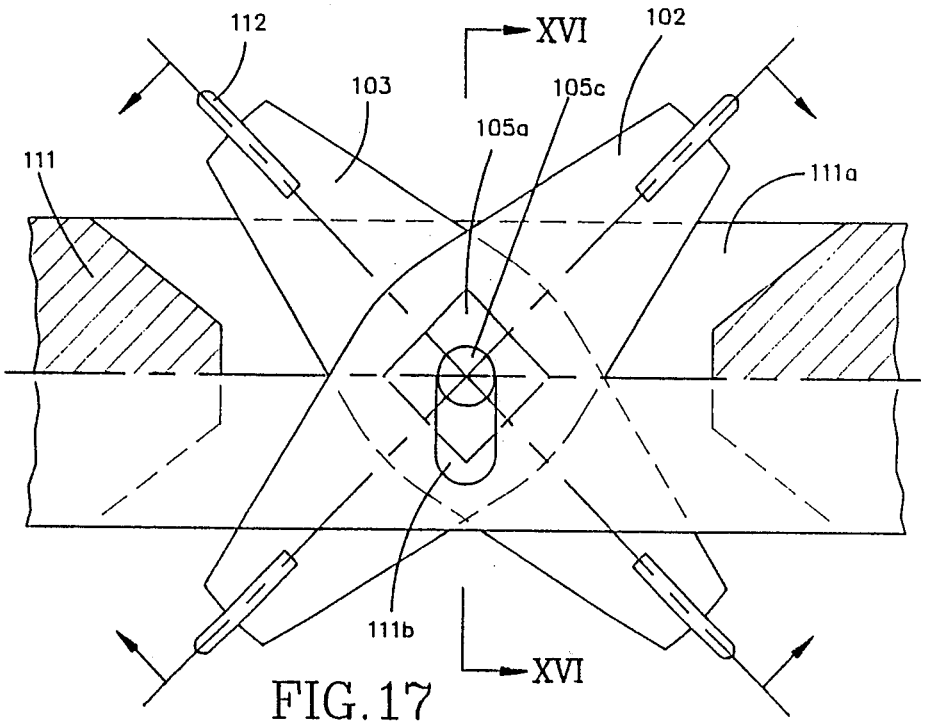
FIG. 17 shows a cross-sectional view of the contact arrangement of FIG. 16 along section plane XVII—XVII in FIG. 16.

In the contact devices according to FIGS. 16 and 17, in each case, two outer contact elements 102 and a middle contact element 103, all with a profile similar to the design in FIG. 13, are arranged with rectangular-profiled channels **102*a* and 103*a* passing through them, aligned one behind the other. A torsion spring 105, acting in the same way as in the preceding example, is provided, again, with profiled sections 105*a* and 105*b*, which are adapted to the channel profile, and assigned to the contact elements 102 and 103. Between the profiled sections are formed relatively torsion-soft spring sections 109** of which the diameter is less than the least diameter of the profile section in the particular case. In this way, the torsion springs may be made of high-strength material, for example, of spring steel, while a design of the torsion springs according to the preceding example, with its torsion springs greater in diameter, allows the use of material with lower elasticity modulus, for example, of suitable plastics, which allow an especially economical manufacturing.

The symmetrical arrangement of the three contact elements results in a contact that is substantially in statical equilibrium. However, at the ends of the torsion springs are provided guide pegs **105*c*, which engage in slots 11*b* of opposite edge sections 11*a* of a cage-like guide device. In this manner not shown in detail, there is provided in this case also, the possibility of producing larger contact fields, for example, even flat contact fields for connection to heavy current buses. To increase the current carrying load, there is used again an elastically resilient contact lamella 112 on the outer edges of the contact elements 102 and 103**.

Figure 18:
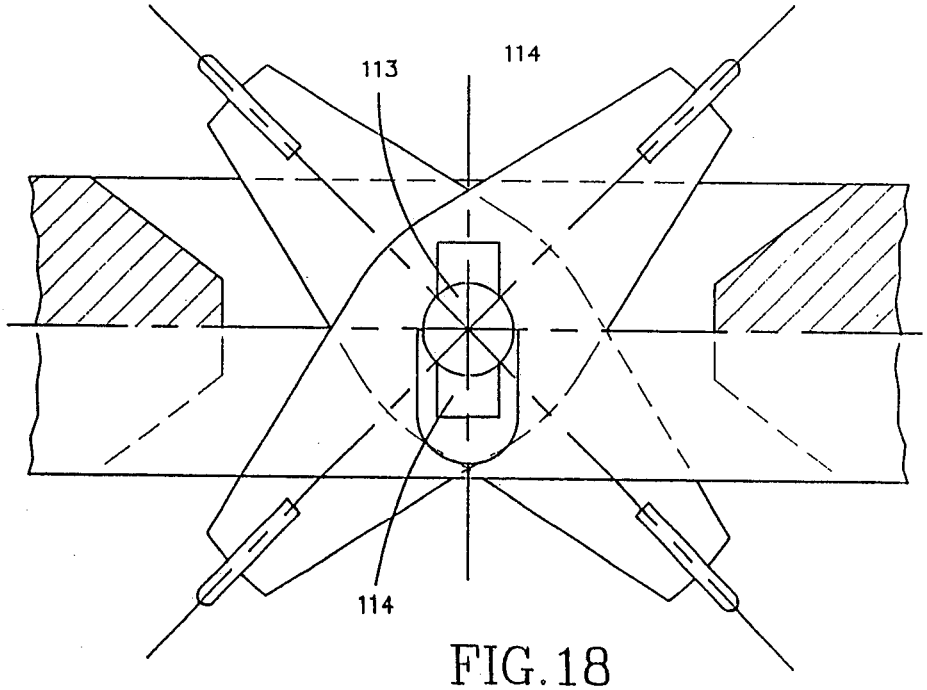
FIG. 18 shows a modified view of the contact arrangement of FIG. 17.

The modification according to FIG. 18 shows, in a device according to FIG. 17, the possibility of using a cylindrical torsion spring rod 113 with profiled sections 114 of large dimension and marked projection radially, for the torsion coupling of the contact. Such a design permits especially large power transmission surfaces between torsion spring and contacts. It is, therefore, to be considered especially for cheap torsion springs made from plastic.

We claim:

1. An electric contact device for forming a conducting connection between connectors comprising a plurality of contact elements and at least one spring element common to the plurality of contact elements for biasing the contact elements against the connectors, characterized in that the spring element is a spring band having a plurality of openings into which the contact elements extend, one contact element extending into one opening, and in that the contact elements in an unstressed condition, are inclined at a maximum angle of 45° relative to the plane of the spring band and are secured to the spring band by catch means.

2. An electric contact device according to claim 1, characterized in that the openings in the spring band are formed as slots extending transverse to the lengthwise direction of the spring band, that the slots form one or more rows extending lengthwise of the spring band, that the catch means formed on the contact elements include opposite catch grooves arranged in a common plane in working connection with edge zones surrounding the slots, and that the position of the catch grooves on the contact elements is determined in accordance with a desired angle between the contact elements and the plane of the spring band.

3. An electric contact device according to claim 1 or 2, characterized in that the spring band consists of at least two band portions joined together.

4. An electric contact device for forming a conducting connection between connectors comprising a plurality of contact elements, and at least one spring element common to the plurality of contact elements for biasing the contact elements against the connectors, characterized in that each contact element comprises at least one opening extending through the contact element between opposite end surfaces thereof, that the spring element extends through the opening, and that the plane of the contact element forms with the opening a predetermined angle.

5. An electric contact device according to claim 4, characterized in that the spring element is formed as a spring band, and the opening has the form of a slot located in the center of the contact element, and that the width of the opening corresponds to the thickness of the spring band.

6. An electric contact device according to claim 4, characterized in that the electric contact device comprises a plurality of spring elements formed as spring bands and extending at least approximately parallel to each other, and that each contact element is provided in the edge zone with two opposite slot-form openings the width of which corresponds to the thickness of the spring band.

7. An electric contact device according to claim 5 or 6, characterized in that the spring band is flat, in the unstressed condition, and that the predetermined angle is maximum 45°.

8. an electric contact device according to claim 5 or 6, characterized in that the spring band in the unstressed condition comprises one or more waves, and that the predetermined angle is 90°.

9. An electric contact device according to claim 4, characterized in that spring elements comprises spring wires arranged at least approximately parallel to each other, and that each contact element has in its edge zone, two opposite slot-form openings the width of which corresponds to the diameter of the spring wire.

10. An electric contact device according to claim 4, characterized in that the spring elements comprises spring wires arranged at least approximately parallel to each other, and that each contact element has in its edge zone two opposite bores for receiving the spring wires.

11. An electric contact device according to claim 9 or 10, characterized in that the spring wires, in unstressed condition, extend as a straight line, and that the predetermined angle is maximum 45°.

12. An electric contact device according to claim 9 or 10, characterized in that the spring wires, in unstressed condition, comprise one or more waves, and that the predetermined angle is 90°.

13. An electric contact device according to claims 4, 5, 6, 9 or 10, characterized in that the contact elements extend in several rows in a side-by-side relationship and that the respective spring elements are joined together.

14. An electric contact device according to claim 1, 2, 4, 5, 6, 9, or 10 characterized in that the contact surfaces of the contact elements formed of contact lamella made from a material with high electroconductivity are provided at the edge zones of the contact element.

15. An electric contact device according to claim 14, characterized in that in the edge zones of the contact lamella abutting the connectors are provided with slots.

16. An electric contact device according to claim 15, characterized in that the slotted edge zones are resilient.

17. An electric contact device according to claim 1, 2, 4, 5, 6, 9, 10, 15 or 16, characterized in that the contact elements are wound, to form contact surfaces, with wire or rope shape high electroconductive material.

18. An electric contact device for forming a conducting connection between connectors comprising a plurality of contact elements and at least one spring element, common to the plurality of contact elements for biasing the contact elements against the connectors, characterized in that the spring element has support elements defined by openings provided for positioning of the contact elements, and that the contact elements completely enclose respective support elements and, in the unstressed condition, are inclined at an angle maximum of 45° relative to the plane of the spring element.

19. An electric contact device according to claim 18, characterized in that the contact elements comprises pockets made of a highly electroconductive material.

20. An electric contact device according to claim 18 or 19, characterized in that the support elements have the form of cross-pieces extending in one or more rows in side-by-side relationship in the lengthwise direction of the spring element between two edge strips thereof.

21. An electric contact device according to claims 18 or 19, characterized in that the electric contact device comprises at lease two spring elements having support elements in the form of tongues arranged in a row extending lengthwise of the spring element, and forming one piece with a connection strip, the tongues of spring elements projecting from opposite sides into respective contact element whereby the tongues are fixedly connected.

22. An electric contact device for forming of a conducting connection between connectors comprising a plurality of contact elements pivotally supported relative to the connectors and at least one spring element common to the plurality of contact elements for biasing the contact elements against the connectors, characterized in that at least two contact elements are arranged one after the other about their pivot axes and are joined together by at least one torsion spring, so that in the biased condition relative to the connectors, they are under opposite rotary prestress.

23. An electric contact device according to claim 22, characterized in that at least two contact are arranged aligned in the direction of their pivot axis and have channels extending over at least a portion of the axial extent of the contact elements, also substantially aligned, for receiving torsion springs.

24. An electric contact device according to claim 18 or 19, characterized in that the torsion spring is rod-shaped and has at least two axially spaced profiled sections to provide rotary geometrical closing connections with the contact elements.

25. An electric contact device according to claim 24, characterized in that the torsion spring has, in the zone between the profiled sections torsion rod sections having a diameter less than the smallest profile diameter.

26. An electric contact device according to claim 22, 23 or 25, characterized in that a plurality of contact elements extending axially one after the other is arranged in a side-by-side relationship to form a multiple contact field, and that a guide device is provided to keep parallel the pivot axes of the contact elements.

27. An electric contact device for forming of conducting connection between connectors comprising a plurality of pivotally supported contact elements and at least one spring element common to the plurality of contact elements, for biasing the contact elements against the connectors, characterized in that a band-shaped spring or a wire-shaped spring extends over the plurality of contact elements and is provided, at least in the space between the contact elements, with a sheath for securing the position of the contact elements, especially maintaining the spacing of the contact elements.

28. An electric contact device according to claim 27, characterized in that the sheath comprises at least one hollow body, especially a hollow profiled body, with a closed profiled circumference.

29. An electric contact device according to claim 28, characterized in that the sheat comprises at least one hose or tubular body.

30. An electric contact device according to claim 28, characterized in that the sheat comprises a row of a plurality of spaced ring-like hollow bodies extending one after another.

31. An electric contact device according to claim 27, 28, 29 or 30, characterized in that the sheat comprises a plurality of hollow bodies arranged between adjacent contact elements and acting as spacers the end surfaces of which abut the contact elements.

32. An electric contact device according to claim 27, 28, 29, or 30, characterized in that the sheath extends over a plurality of contact elements and grips through the openings formed therein.

33. An electric contact device according to claim 27, 28, 29, or 30, characterized in that the sheath consists at least partially of soft elastic and/or soft plastic material.

* * * * *